US005640736A

United States Patent [19]

Salecker

[11] Patent Number: 5,640,736

[45] Date of Patent: Jun. 24, 1997

[54] POWER FEED DEVICE FOR HAND HELD DRAIN AND SEWER CLEANER

[75] Inventor: Roy W. Salecker, Mendota, Ill.

[73] Assignee: Pettibone Corporation, Lisle, Ill.

[21] Appl. No.: 527,049

[22] Filed: Sep. 12, 1995

[51] Int. Cl.[6] ..... B04B 9/02

[52] U.S. Cl. ..... 15/104.33; 15/104.31

[58] Field of Search ..... 15/104.03, 104.05, 15/104.31, 104.33, 104.12; 254/134 FT; 74/25; 82/132; 267/175, 177

[56] References Cited

U.S. PATENT DOCUMENTS

| | | | |
|---|---|---|---|
| 3,394,599 | 7/1968 | Tucker | 15/104.33 |
| 3,451,089 | 6/1969 | Carlson et al. | 15/104.33 |
| 3,451,090 | 6/1969 | Presti et al. | 15/104.33 |
| 4,103,881 | 8/1978 | Simich | 267/177 |
| 4,195,659 | 4/1980 | Barthelmes et al. | 267/175 |
| 4,218,802 | 8/1980 | Babb et al. | 15/104.33 |
| 4,395,791 | 8/1983 | Irwin . | |
| 4,580,306 | 4/1986 | Irwin | 15/104.33 |
| 4,686,732 | 8/1987 | Irwin | 15/104.33 |
| 5,029,356 | 7/1991 | Silvermann et al. | 15/104.33 |
| 5,031,263 | 7/1991 | Babb et al. | 15/104.33 |
| 5,031,276 | 7/1991 | Babb et al. | 15/104.33 |
| 5,056,178 | 10/1991 | Levine | 15/104.33 |
| 5,235,718 | 8/1993 | Grimsley . | |
| 5,239,724 | 8/1993 | Salecker et al. | 15/104.33 |
| 5,251,356 | 10/1993 | Oaki . | |
| 5,309,595 | 5/1994 | Salecker . | |
| 5,414,888 | 5/1995 | Irwin . | |
| 5,426,807 | 6/1995 | Grimsley . | |

*Primary Examiner*—David Scherbel
*Assistant Examiner*—Tony G. Soohoo
*Attorney, Agent, or Firm*—McDermott, Will & Emery

[57] ABSTRACT

A power feed device for use with a hand held sewer and drain cleaning machine having an elongate, coiled cable and a rotating means for rotating the cable, the power feed device comprising two rollers rotatably mounted on housings, the housings being rotatably mounted within a body of the device, biasing means for biasing one of the housings and thereby one of the rollers toward the cable, cable centering means for centering the cable between the two rollers, means for rotating the roller housings from a "NEUTRAL" position wherein the axes of rotation of the rollers are parallel to the axis of rotation of the cable such that when the cable is rotated in the first rotational direction the cable is not moved along its elongate axis relative to the rollers, to a "FORWARD" position wherein the axes of rotation of the rollers are skewed to the axis of rotation of the cable and such that when the cable is rotated in the first rotational direction the cable moves along its elongate axis in a first direction, or to a "REVERSE" position wherein the axes of rotation of the rollers are skewed to the axis of rotation of the cable such that when the cable is rotated in the first rotational direction the cable moves along its elongate axis in a second direction which is opposite the first direction.

16 Claims, 5 Drawing Sheets

FIG. 7
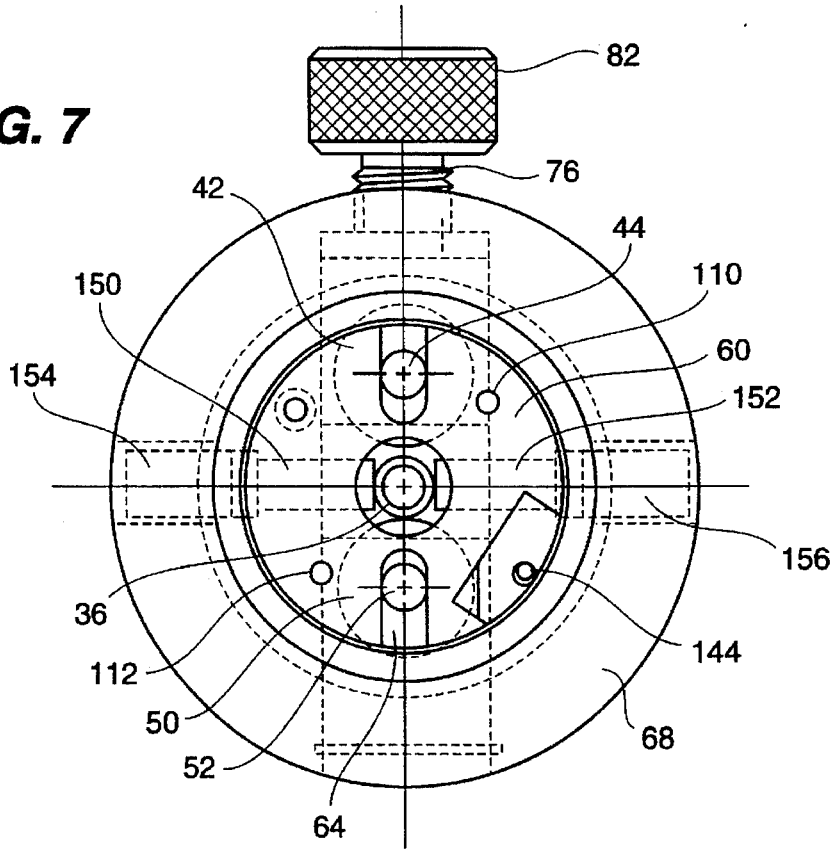
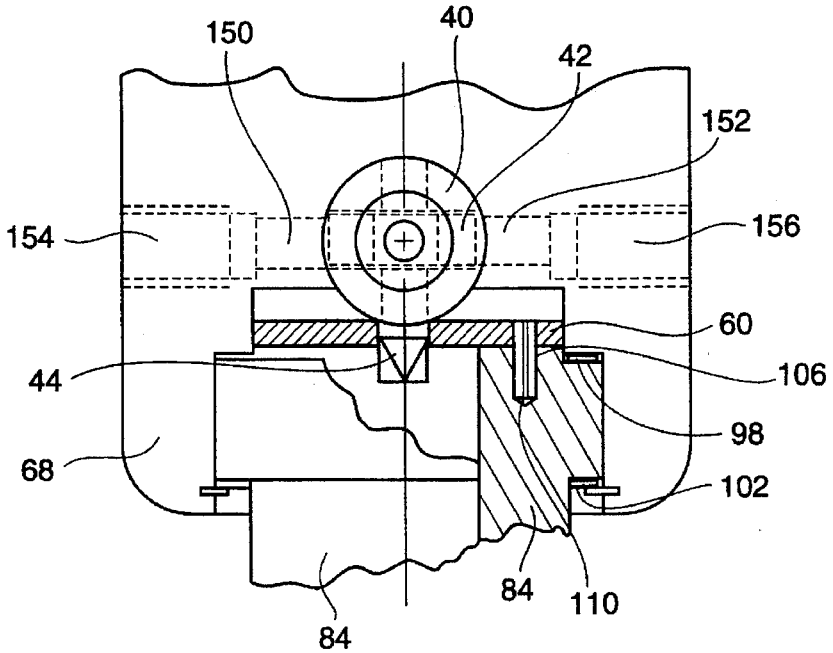
FIG. 8

POWER FEED DEVICE FOR HAND HELD DRAIN AND SEWER CLEANER

BACKGROUND OF THE INVENTION

1. Field of the Invention

This invention relates generally to a power feed device for sewer and drain cleaning cable and, more particularly, to a power feed device that is used with a hand held drain line cleaning device.

2. Background Art

Hand held rotary powered drain cleaners are well known in the art. Generally, they employ a power source, such as an electric drill, which is attached to a rotatable drum unit which houses a sewer and drain cleaning cable having a small diameter. One end of the cable is fed from the drum through a tube which is attached to the drum and a locking device such as a drill chuck. In operation, the cable is pulled by hand from the drum through the drill chuck and fed into the drain and conduit line. As bends or obstructions in the line are encountered the chuck or locking device is secured to the cable, and the cable is rotated by the drill.

A rotatable sleeve allows a person to hold the weight of the unit while rotating the drum and cable and is commonly provided between the drum and locking arrangement. The feeding of cable into or out of the drain or conduit while the cable is rotating is accomplished by pushing and pulling the entire drain cleaning assembly by hand. Once a bend or obstruction is traversed, cable rotation is stopped and the locking device is released from the cable. The cable is then fed from the drum, further into the conduit, by hand. This procedure is often repeated a number of times to clear obstructions from a line.

Other devices that have been used to feed cable by a power feed source are not adapted to be used with hand held drain cleaners and utilize many rollers. Other devices use rollers that have grooves therein which mesh with grooves in the coiled cable. Devices using grooved rollers can only change the direction in which the cable is fed by reversing the rotation of the cable.

SUMMARY OF THE INVENTION

It is one of the principal objectives of the present invention to provide a hand held sewer and drain cleaning device that is small, light and can feed cable into or out of a conduit without stopping rotation of the cable.

It is another object of the present invention to provide a hand held sewer and drain cleaning device that provides control of the direction and feed rate of the cable while rotating the cable in only one direction.

It is still another object of the invention to accomplish the above using only two rollers.

It is a further object of the invention to provide control over the speed in which the cable is fed into or out of a conduit.

It is still further an object of the invention to provide a controlled slip drive on the feed device to prevent the cable from buckling or twisting which may occur when the cable encounters a heavy blockage or obstruction within a conduit.

BRIEF DESCRIPTION OF DRAWINGS

FIG. 7 is a front sectional view of the power feed device taken along the line 7—7 of FIG. 2.

FIG. 8 is a top partly sectional view of the power feed device.

DETAILED DESCRIPTION OF THE DRAWINGS

Figure 1:
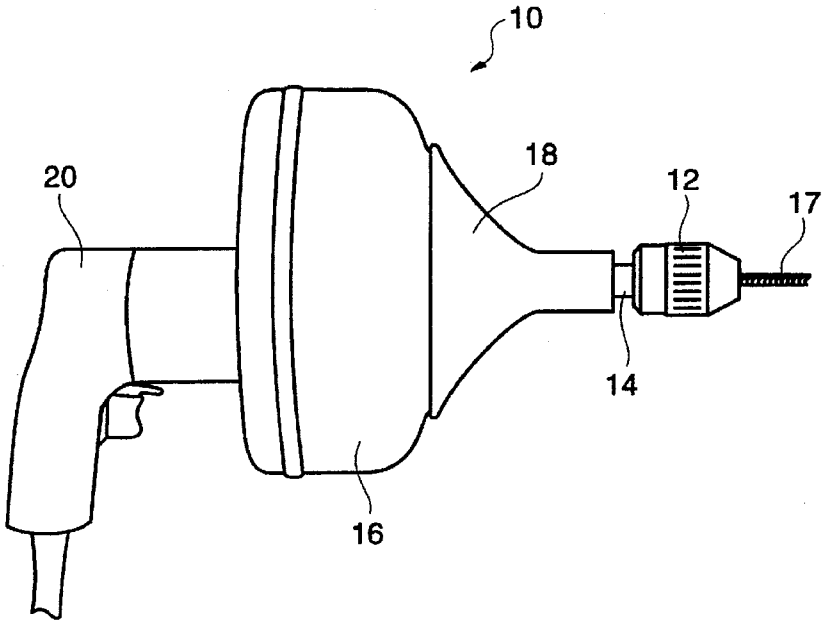
FIG. 1 PRIOR ART
FIG. 1 is a side view of a conventional hand held drain cleaning device.

FIG. 1 shows a prior art drain or conduit cleaner 10. The prior art cleaner 10 includes a conventional hand chuck 12 which is attached to a feed tube 14. The feed tube 14 is attached to a rotatable drum 16 which has cable 17 stored therein. An independently rotatable sleeve 18 is provided between the hand chuck 12 and the drum 16 to provide support for a person operating the cleaner 10 and allows the person to hold the cleaner 10 while the drum 16 and cable 17 rotate. The drum 16 and cable 17 are rotated by a modified electric hand drill 20 which is coupled to the drum 16.

Any movement of the cable 17 into or out of the drum 16, i.e., movement of the cable 17 along its longitudinal axis relative to the cleaner 10, must be done manually and when the cable is not rotating. To adjust the length of the cable 17 that extends form the drum 16, the hand chuck 12 is loosened and the cable 17 is pulled out of or pushed into the drum 16 by hand. When a desired length of cable 17 extends from the drum 16, the hand chuck 12 is tightened around the cable 17 to hold the cable 17 in place. Movement of the rotating cable 17 into or out of a conduit or drain is done only by moving the entire cleaner 10 back and forth while the cable 16 is in the conduit.

Figure 2:
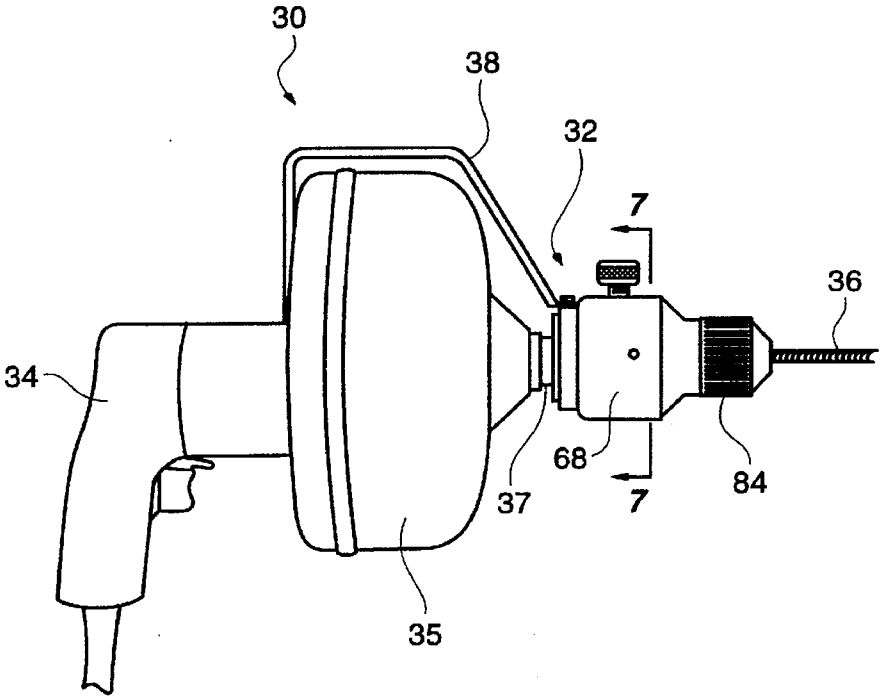
FIG. 2 is a side view of a hand held drain cleaning device according to the present invention.

FIG. 2 shows a hand held cleaner 30 with a power feed device 32 according to the present invention. A drive unit 34 for rotating an elongate, coiled cable 36 or "snake" which is connected to a rotatable drum 35. A feed tube 37 is connected to the drum 35, and the power feed device 32 is connected to the feed tube 37. The drive unit 34 is similar to the modified hand drill 20 shown in FIG. 1.

The rotatable drum 35 also stores the cable 36 therein. The cable 36 extends out of the drum 35, through the feed tube 37 and into the power feed device 32. The feed tube 37 is shorter than the feed tube 14 shown in FIG. 1 and allows the drain cleaner 30 to be more compact than prior art cleaners such as 10. A bracket 38 is attached to the drive unit 34 and to the feed device 32 to prevent rotation of the feed device. The cable 36 can have a diameter of either ¼ inch or 5/16 inch.

Figure 3:
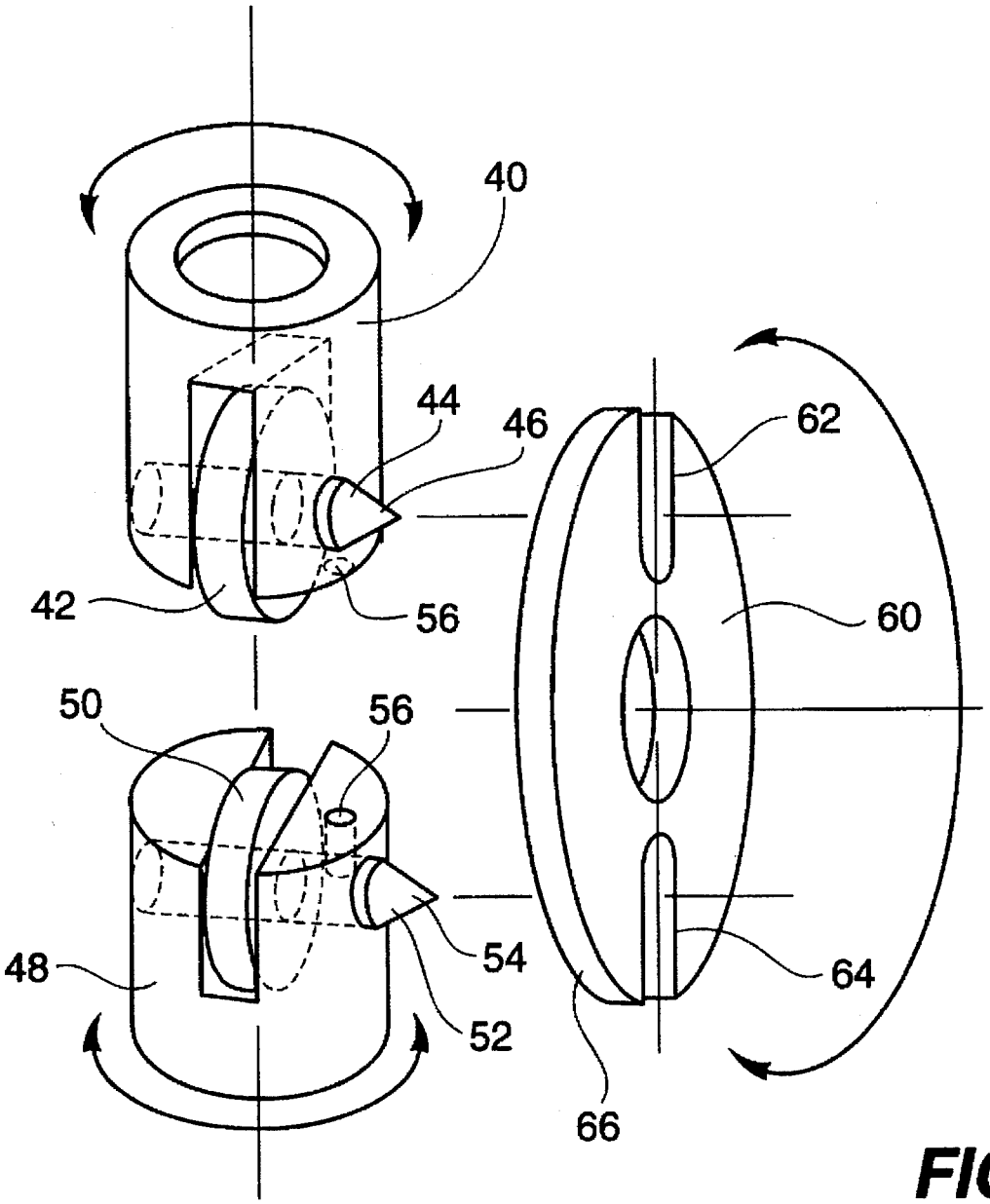
FIG. 3 is a partially exploded view of a subassembly of the power feed device.

Referring now to FIG. 3, a partly exploded view of a subassembly 39 of the feed device 32 is shown. The subassembly 39 controls the speed and direction in which the cable 36 is moved along its longitudinal axis, i.e., into or out of the drum 35. A cylindrical upper housing 40 has a ball bearing roller 42 attached thereto by means of a pin 44. The pin 44 has a tapered end 46 with a smooth conical surface 47 that extends out of the upper housing 40. A lower housing 48 also has a ball bearing roller 50 attached thereto by means of a pin 52, which also has a tapered end 54 with a smooth conical surface 55 that extends out of the lower housing 48.

Both pins 44, 52 are held in position within their respective housings 40, 48 by set screws 56, 58.

A generally circular plate 60 is positioned adjacent the housings 40, 48. The plate 60 has two diametrically opposed slots 62, 64 therein for receiving the pins 44, 52. The slots 62, 64 extend radially inwardly from a peripheral edge 66 of the plate 60 and extend toward, but do not reach, the center of the plate 60. The plate 60 is placed adjacent the housings 40, 48 so that the slots 62, 64 receive the pins 44, 52. One pin 44 is received within the upper slot 62 and the other pin 52 in received within the lower slot 64. Minimal clearance is provided between the pins 44, 52 and the slots 62, 64. The plate 60 also has a central bore 67 therein through which the cable 36 passes.

Figure 9:
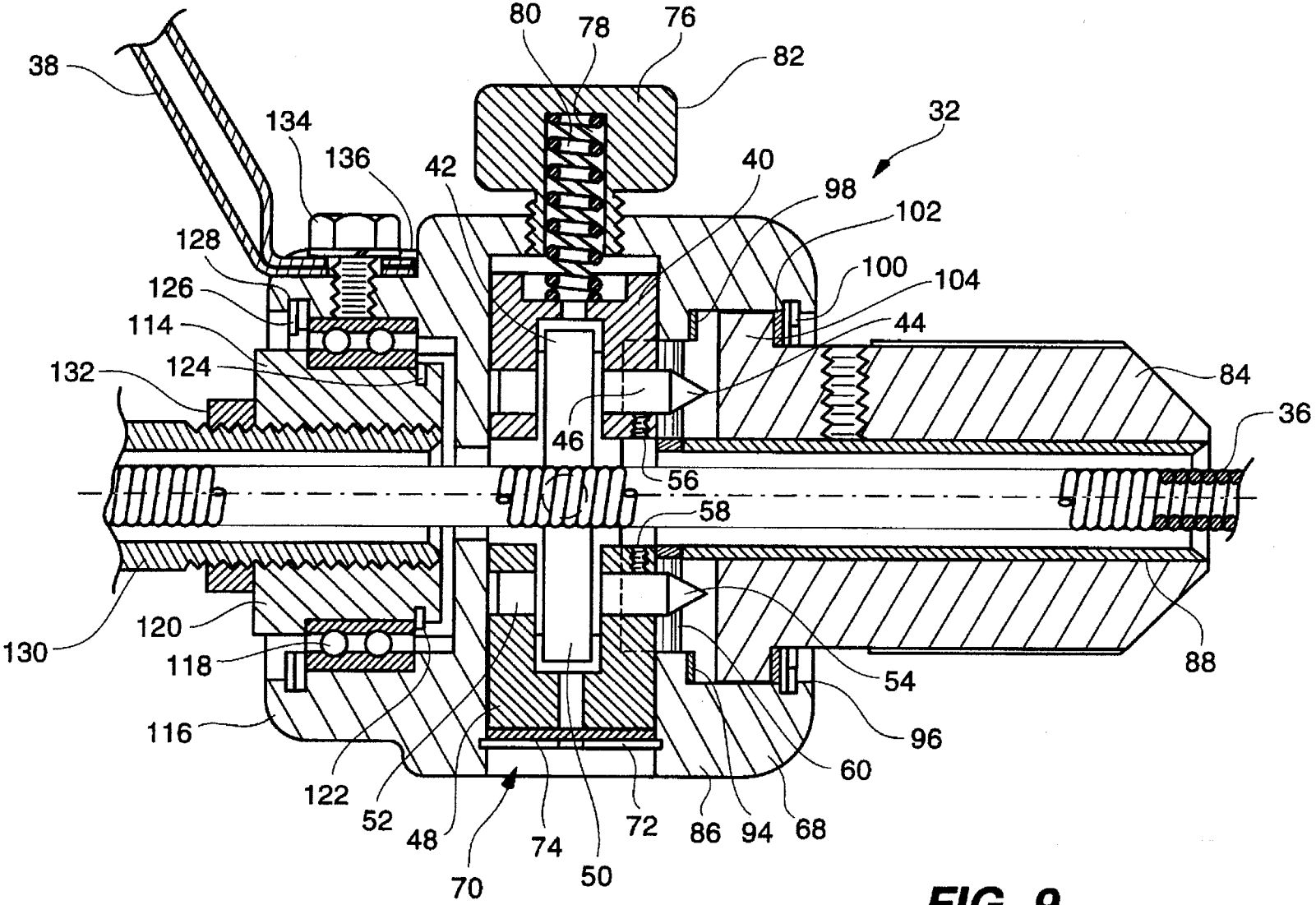
FIG. 9 is a side sectional view of the power feed device.

Referring now to the sectional side view of the device 32 shown in FIG. 9. The upper and lower housings 40, 48 are shown mounted within a body 68 of the power feed device 32. The housings 40, 48 are received within a bore 70 in the body 68 and are held in place by a snap or spring ring 72. A thrust washer 74, made of a low friction material such as tetrafluoroethylene (TFE) which is commonly sold under the trademark name Teflon®, is placed between the ring 72 and the housings 40, 48 to provide low resistance between the housings 40, 48 and the ring 72 and allow the housings 40, 48 to rotate within the bore 70.

A screw 76 is threaded through the body 68 of the device 32. The screw 76 has an axially bore 78 therein and a spring 80 is placed within the bore 78. One end of the spring 80 bears against the upper roller housing 40. The spring 80 biases the upper housing 40, and thereby the roller 42, toward the cable 36. As the upper housing 40 is biased toward the cable 36, the cable 36 is pressurally engaged between the rollers 42, 50. The two rollers are angularly spaced apart approximately 180° from each other on said cable.

As the screw is threaded downwardly, the spring applies more pressure to the housing, which causes greater pressural engagement of the cable 36 between the rollers 42, 50. Similarly, as the screw is threaded upwardly, the spring applies less pressure to the housing, which causes less pressural engagement of the cable 36 between the rollers 42, 50. The screw 76 does not contact the upper housing 42 directly. Contact between the screw 76 and upper housing 42 is prevented by a knob 82 on the top of the screw 76 which contacts the body 68 before the screw 76 can contact the housing 42.

A nose piece 84 is rotatably mounted within a distal portion 86 of the body 68 of the power feed device 32. The nose piece 84 is made of aluminum or another light material such as plastic. The nose piece 84 has an axial bore 88 therethrough. After the cable 36 passes between the rollers 42, 50, the cable 36 is inserted into the bore 88. To prevent wear of the nose piece 84, a generally cylindrical liner 90 is placed within the bore 88 and the cable 36 is placed within the liner 90. The liner 90 can be made of carbon steel or stainless steel. The liner 90 is held within the bore 88 by a set screw 92 and can be easily replaced when worn.

The distal portion 86 of the body 68 of the power feed device 32 has an annular shoulder 94 and an annular groove 96 that is spaced apart from the shoulder 94. When the nose piece 84 is properly inserted within the distal portion of the body 68 one end of the nose piece 84 abuts the annular shoulder 94. A washer 98 made of Teflon® or other low friction material is placed between the shoulder 94 and the nose piece 84 so that the nose piece 84 can be rotated within the body 68. A snap ring 100 is placed in the groove 96 to maintain the nose piece 84 within the body 68, and a washer 102 made of Teflon® or other low friction material is placed between the nose piece 84 and body 68 to allow for easy rotation of the nose piece 68 within the body 68.

A proximal end 104 of the nose piece 84 has two axially extending bores 106, 108 therein which receive axially extending pins 110, 112 mounted on the flat plate 60. (See FIGS. 7 and 8) As will be explained below with reference to FIGS. 4A–4B through 6A–6B, when the pins 110, 112 are placed within the bores 106, 108 of the plate 60, rotation of the nose piece 84 causes corresponding rotation of the plate 60 and housings 40, 48.

A hub assembly 114 is attached to the feed tube 37 and is received within a proximal end 116 of the body 68. The hub assembly 114 is threaded onto a distal end 130 of the feed tube 37 and locked in place by a lock nut 132. Note that the bracket 38 is attached to the body 68 by a bolt 134 and a lock washer 136.

The hub assembly 114 has a ball bearing 118 fitted thereon which allows the hub assembly 114 to rotate within the body 68. The hub assembly 114 also has an annular shoulder 120 thereon. An annular groove 122 in the hub assembly 114 is spaced distally from the annular shoulder 120. To fasten the hub assembly 114 to the body 68, a first snap or spring ring 124 is placed within the groove 122 in the hub assembly 114. The spring ring 124 retains the ball bearing 118 between the snap ring 124 and the shoulder 120. A second snap or spring ring 126 is placed within a groove 128 in the proximal end 116 of the body 68 and contacts the ball bearing 118 to retain the ball bearing 118, and thereby the hub assembly 114, in place within the body 68.

Instead of manually feeding the cable 36 into or out of the drum 35 as is done with the hand held conduit cleaner 10 shown in FIG. 1, the power feed device 32 allows the cable 36 to be moved along its longitudinal axis, i.e., into or out of the drum 35 or into or out of a conduit, while the drum 35 and cable 36 are rotating. The operation of the device 32 is explained below with reference to FIGS. 4A–4B through FIGS. 6A–6B.

Figure 4A:
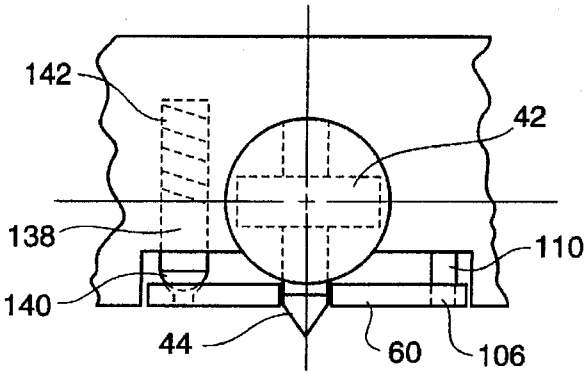
FIGS. 4A and 4B are top and front views of the power feed device in a "NEUTRAL" position.
Figure 4B:
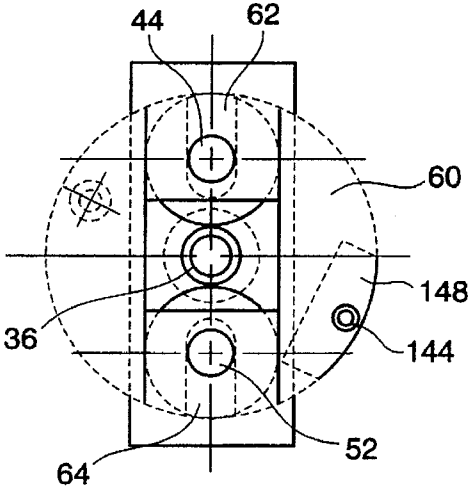

The subassembly 38 is shown in FIGS. 4A and 4B in a "NEUTRAL" position. When the subassembly is in the "NEUTRAL" position, a round headed pin 138 in the body 68 of the device 32 snaps into a generally circular detent 140 in the flat circular plate 60. The pin 138 is biased toward and snapped into the detent 140 by a spring 142. When snapped into the detent 140, the pin 138 provides a small amount of added resistance whereby a person using the device 32 can easily identify when the device 32 is in the "NEUTRAL" position.

When the subassembly 38 and roller 42, 50 are in the "NEUTRAL" position, no forward or reverse movement of the cable 36 along its longitudinal axis occurs. The cable 36 is rotated in a first direction by the drive unit 34. The rollers 42, 50 pressurally engage the cable 36, however, the axes of the rollers 42 and 50 are parallel to the longitudinal axis of the cable and the rollers 42, 50 rotate in the same plane as the cable 36. Because the rollers 42, 50 rotate in the same plane as the cable 36, the cable 36 is not driven forward or backward by the rollers 36.

Figure 5A:
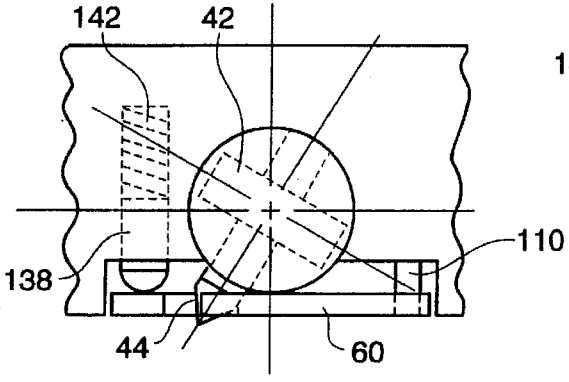
FIGS. 5A and 5B are top and front views of the power feed device in a "FORWARD" position.
Figure 5B:
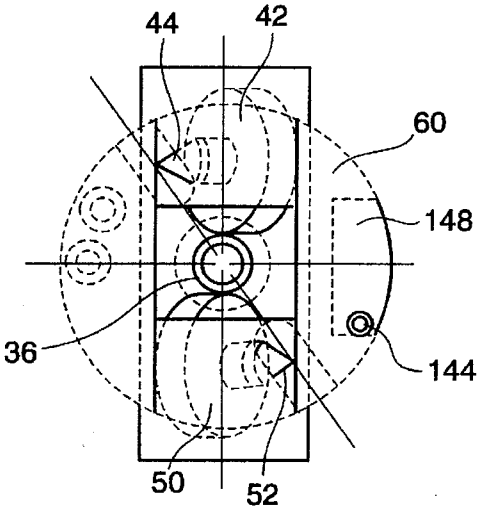

If the nose piece 84 and the plate 60 are turned in a first direction, from the "NEUTRAL" position in FIGS. 4A–4B, to a "FORWARD" position shown in FIGS. 5A–5B, the pins 44, 52, housings 40, 48 and rollers 42, 50, rotate in opposite directions and thereby cant or angle the rollers 42, 50 relative to the cable 36. In other words, the axis of rotation of the rollers 42, 50 is now skewed to the axis of rotation of the cable 36. Because the rollers 42, 50 pressurally engage the cable 36 and are now canted with respect to the cable 36, rotation of the rollers 42, 50 provides helical drive to the cable 36 and moves the cable 36 along its longitudinal axis in a first or forward direction. Note that the cable 36 is still rotated by the drive unit 34 in the first direction.

A stop pin 144 such as a roll pin is placed in the body 68 and projects into an opening 148 in the plate 60 to limit rotational movement of the plate 60 and thereby prevent the pins 44, 52 on the housings 40, 48 from exiting the slots 62, 64 in the plate 60.

Figure 6A:
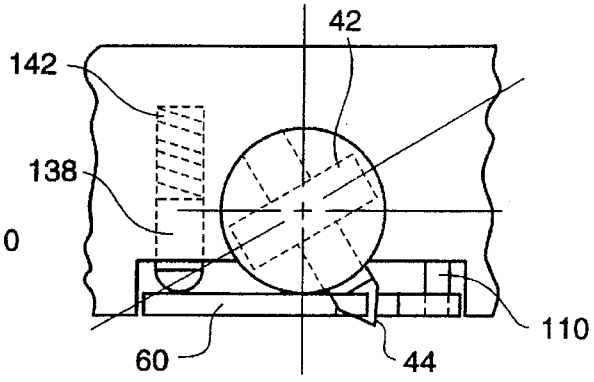
FIGS. 6A and 6B are top and front views of the power feed device in a "REVERSE" position.
Figure 6B:
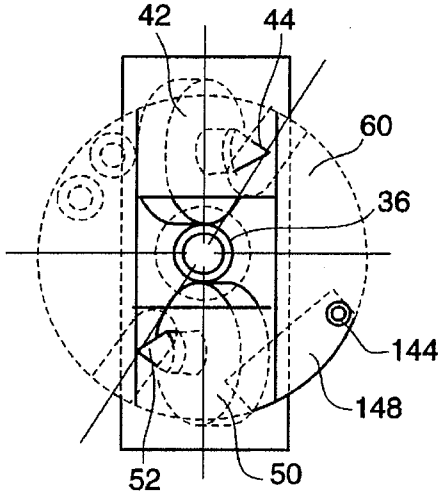

FIGS. 6A–6B show the plate 60 turned in a second direction from the "NEUTRAL" position, to a "REVERSE" position in which the rollers 42, 50 cause the cable to move the rotating cable 36 along its longitudinal axis in a second or reverse direction which is opposite the forward direction. The helical drive provided by the rollers 42, 50 is reversed because the rollers 42, 40 are canted in opposite directions with respect to the cable 36 and the cable 36 is still rotated by the drive unit 34 in the first direction.

Note that the stop pin 144 is at the other end of the opening 148 in the plate 60 and prevents further rotation of the plate 60 in the second direction.

Referring now to FIG. 7 which is a sectional front view of the subassembly 38 in the "NEUTRAL" position. FIG. 7 shows the plate 60 in place over pins 44, 52 and the stop pin 144 centrally positioned in the opening 148. The two mounting bores 106, 108 in the nose piece 84 which receive the pins 110, 112 of the plate 60 are also shown. FIG. 7 also shows two shouldered guide pins 150, 152 which are held in position within the body 68 by two set screws 154, 156. The pins 150, 152 are inserted into the body 68 and positioned opposite each other along the horizontal center of the subassembly 38. The pins 150, 152 have a predetermined length to keep the cable 36 centered between the rollers 42, 50. The predetermined length depends on the diameter of the cable 36 being used in the device 32 and the diameter of the body 68 of the subassembly 38.

FIG. 8 shows a sectional top view of the plate 60 with one of the roll pins 110 inserted through one of the mounting bores 106 which attaches the steel plate 60 to the nose piece 84.

From the foregoing description, it will be apparent that the power feed device of the present invention has a number of advantages, some of which have been described above and others of which are inherent in the power feed device of the present invention. Also, it will be understood that modifications can be made to the power feed device of the present invention without departing from the teachings of the invention. Accordingly the scope of the invention is only to be limited as necessitated by the accompanying claims.

I claim:

1. A power feed device for use with a sewer and drain cleaning machine having a drum, an elongate cable having a longitudinal axis and a rotating means for rotating the cable, said power feed device comprising:

a main housing coupled to the drum;

first and second roller housings mounted within said main housing;

first and second rollers rotatably mounted within said first and said second roller housings, respectively;

biasing means for biasing one of said rollers toward the cable;

cable centering means for centering the cable between said two rollers; and, means for moving said rollers from a first position wherein the cable is not moved along its elongate axis relative to the rollers when the cable is rotated in a first rotational direction, to a second position wherein the cable moves along its elongate axis in a first direction when the cable is rotated in the first rotational direction, said means for moving said rollers from said first position to said second position including a roller coupling plate for coupling said first and second rollers and a rotatable nose piece mounted on said main housing whereby rotation of said nose piece causes movement of said roller coupling plate and corresponding movement of said rollers from said first position to said second position.

2. The power feed device of claim 1 wherein said means for moving said rollers further includes means for moving said rollers to a third position wherein the cable moves along its longitudinal axis in a second direction, opposite said first direction, when the cable is rotated in the first rotational direction.

3. The power feed device of claim 1 wherein said biasing means includes a screw having a hollow shaft mounted in said main housing and a spring positioned in the shaft and wherein said spring engages one of said roller housings and biases said roller housing and said roller toward the cable.

4. The power feed device of claim 3 wherein said screw and said spring can be adjusted so that greater or lesser pressure is applied by said rollers to the cable.

5. The power feed device of claim 1 wherein said cable centering means includes two shouldered pins mounted in said main housing, said shouldered pins extending radially inwardly toward the cable and having a predetermined length whereby the cable is centered between said rollers.

6. The power feed device of claim 1 further including mounting pins for mounting said rollers to said roller housings, and wherein said roller coupling plate has a central bore therein through which the cable can pass, two axially extending pins and two radially inwardly extending slots for receiving said mounting pins;

said nose piece having two bores therein for receiving said two axially extending pins on said coupling plate; and said nose piece being partially inserted into a distal end of said main housing;

whereby rotation of said nose piece causes corresponding rotation of said coupling plate and said roller housings.

7. The power feed device of claim 6 wherein said mounting pins have tapered ends with flat conical surfaces and when said rollers are rotated out of said first position, said flat conical surfaces of said tapered ends of said mounting pins reciprocally engage flat surfaces in said slots of said coupling plate.

8. The power feed device of claim 6 further including means for preventing said mounting pins from becoming disengaged with said slots in said coupling plate.

9. The power feed device of claim 8 wherein said means for preventing said mounting pins from becoming disengaged from said slots includes a slot and pin assembly, including a pin in said main housing and a slot in said coupling plate, wherein said pin extends into said slot and rotational movement of said coupling plate relative to said roller housings is constrained by said pin.

10. The power feed device of claim 1 wherein said rollers are angularly spaced apart approximately 180° about said cable.

11. A sewer and drain cleaning machine having a cable having an elongate axis for clearing obstructions in a sewer or drain comprising:

rotating means for rotating the cable in a first rotational direction;

feed means for feeding the cable along its elongate axis while the cable is rotating in the first rotational direction, said feed means including a main housing and two rollers rotatably mounted within the main housing; centering means for centering the cable between said rollers; and, means for moving said rollers from a first position wherein the cable is not moved along its elongate axis relative to the rollers when the cable is rotated in the first rotational direction, to a second position wherein the cable moves along its elongate axis in a first direction when the cable is rotated in the first rotational direction, said means for moving said rollers from said first position to said second position includes a roller connecting means for connecting said first and said second rollers and a rotatable nose piece mounted to said main housing and coupled to said connecting means, whereby rotation of said nose piece causes movement of said connecting means and corresponding movement of said rollers from said first position to said second position.

12. The hand held sewer and drain cleaning machine of claim 11 further including biasing means for biasing one of said rollers toward the cable.

13. The sewer and drain cleaning machine of claim 12 wherein said biasing means includes a spring in the main housing of the device, said spring biasing one of said rollers toward the cable and the other of said rollers.

14. The sewer and drain cleaning machine of claim 11 wherein said centering means includes two shouldered pins mounted in said main housing, said shouldered pins extending radially inwardly toward said cable and having a predetermined length whereby said cable is centered between said rollers by said pins.

15. The hand held sewer and drain cleaning machine of claim 11 wherein said rollers are positioned on oppsite sides of said cable.

16. The machine of claim 11 wherein said means for moving said rollers further includes means for moving said rollers to a third position wherein the cable moves along its elongate axis in a second direction, opposite said first direction, when the cable is rotated in the first rotational direction.

* * * * *